US005476045A

United States Patent [19]

Chung et al.

[11] Patent Number: 5,476,045

[45] Date of Patent: Dec. 19, 1995

[54] LIMITED RANGE PROJECTILE

[75] Inventors: Sung K. Chung, Dover; Roy W. Kline, Newton, both of N.J.

[73] Assignee: The United States of America as represented by the Secretary of the Army, Washington, D.C.

[21] Appl. No.: 338,712

[22] Filed: Nov. 14, 1994

[51] Int. Cl.[6] ..... F42B 8/12

[52] U.S. Cl. ..... 102/529; 102/517; 244/3.1; 244/3.23; 244/3.3

[58] Field of Search ..... 102/444, 498, 102/501, 517, 521, 529; 244/3.1, 3.23, 3.24, 3.25, 3.3

[56] References Cited

U.S. PATENT DOCUMENTS

| | | | |
|---|---|---|---|
| H 768 | 3/1990 | Kline et al. | 102/529 |
| 1,794,141 | 2/1931 | Bloch-Jorgensen | 102/517 |
| 4,153,223 | 5/1979 | Romer et al. | 244/3.1 |
| 4,520,972 | 6/1985 | Diesinger et al. | 102/529 |
| 4,653,403 | 3/1987 | Paine | 102/529 |
| 4,765,248 | 8/1988 | Kruse et al. | 102/529 |
| 5,070,791 | 12/1991 | Dineen et al. | 102/517 |
| 5,125,344 | 6/1992 | Kline et al. | 102/529 |
| 5,295,428 | 3/1994 | Hertmann et al. | 102/444 |
| 5,328,130 | 7/1994 | Gilman et al. | 102/517 |

FOREIGN PATENT DOCUMENTS

| | | | |
|---|---|---|---|
| 2831574 | 2/1979 | Germany | 102/529 |
| 201161 | 8/1967 | U.S.S.R. | 102/520 |
| 2091856 | 8/1982 | United Kingdom | 102/529 |
| WO86/6827 | 11/1986 | WIPO | 102/529 |

*Primary Examiner*—Harold J. Tudor

*Attorney, Agent, or Firm*—Anthony T. Lane; Edward Goldberg; Michael C. Sachs

[57] ABSTRACT

A statically stable limited range projectile utilizes a fin assembly combined with a cylindrical body and low drag ogival front end to ballistically match the limited predetermined range flight characteristics of a standard round.

3 Claims, 1 Drawing Sheet

LIMITED RANGE PROJECTILE

GOVERNMENTAL INTEREST

The invention described herein may be manufactured, used and licensed by or for the U.S. Government.

BACKGROUND OF THE INVENTION

Many military training facilities do not have sufficiently large areas to accommodate the range of standard small caliber ammunition. Since small caliber ammunition are particularly easy to launch in an unintended direction, a safety hazard may exist. Bullets are often well outside of partially enclosed training ranges thereby endangering others. To prevent this from occuring barriers have to be constructed or the shooting range has to be further extended at substantial cost. Thus, a projectile with limited range as hereinafter described would have both economic and safety advantages. For good simulation personnel experience and safety, it is desirable to have the training ammunition ballistically match the performance of standard ammunition to the maximum range of interest and then fall well short of the range of standard ammunition. It is also important to have a training round which is not only similar in appearance but one that is also inexpensive to manufacture.

Prior art limited range training rounds frequently failed to provide realistic training because they did not ballistically match the standard ammunition, their light weight precluded firing from an automatic weapon, their range was not adequately limited, and they were often expensive to manufacture. The desired maximum range of a training round fired from a service rifle is approximately two hundred meters. Inadvertently firing a rifle at an angle higher than intended by as little as ten degrees will result in a service round range of thousands of meters.

In the past, prior art statically unstable training rounds have been designed to be first gyroscopically stable by spin and then destabilized with either forward or aft mounted aerodynamic surfaces that dampen spin. The problem with the aforementioned was that they were unpredictably sensitive to varying atmospheric conditions and minor manufacturing part tolerance variations. When fired in a low density atmosphere, these prior art devices retain their gyroscopic stability for a longer distance thus flying to a longer range than desired. However, in a high density atmosphere they differ ballistically from the service ammunition at the target range.

Some prior art statically stable limited range training rounds depend on super caliber aerodynamic surfaces and therefore require the use of a sabot which increases their cost. Other prior art training rounds use high drag aerodynamic surfaces to limit their range. This precludes ballistic match to the range of interest. These prior art designs are expensive and not suitable for an automatic rifle.

Prior art devices for limited range training projectiles which utilize a Mach number dependent transition from static stability to static instability usually have no fins to generate high yaw drag. The aforementioned training round would be unsuitable for rifled barrels since it requires a relatively small spin rate to be gyroscopically stable, thus it would continue in undesired low drag long range flight. Also, this type of training round is limited to launch at a particular Mach number.

SUMMARY OF THE INVENTION

The present invention relates to a statically stable limited range training projectile which can be used at any training facility lacking sufficient space to accommodate the range of standard ammunition and required to provide ballistic match therewith. The present invention provides an extra margin of safety, gives training range commanders more latitude in their operations, and permits the military to include combined arms exercises.

An object of the present invention is to provide a limited range training projectile which ballistically matches a service round launched from a rifled gun barrel.

Another object of the present invention is to provide a training round with limited range which ballistically matches service rounds designed for smooth bore guns.

Another object of the present invention is to provide a limited range training projectile which closely matches the ballistic performance of a service round, wherein the training round will undergo spin yaw resonance instability at or near a predetermined range.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DETAILED DESCRIPTION OF THE PREFERRED EMBODIMENTS

Figure 1:
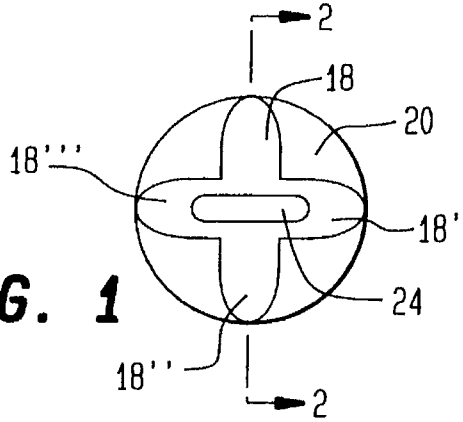
FIG. 1 is a base end view of a statically stable limited range projectile for a rifled gun.
Figure 2:
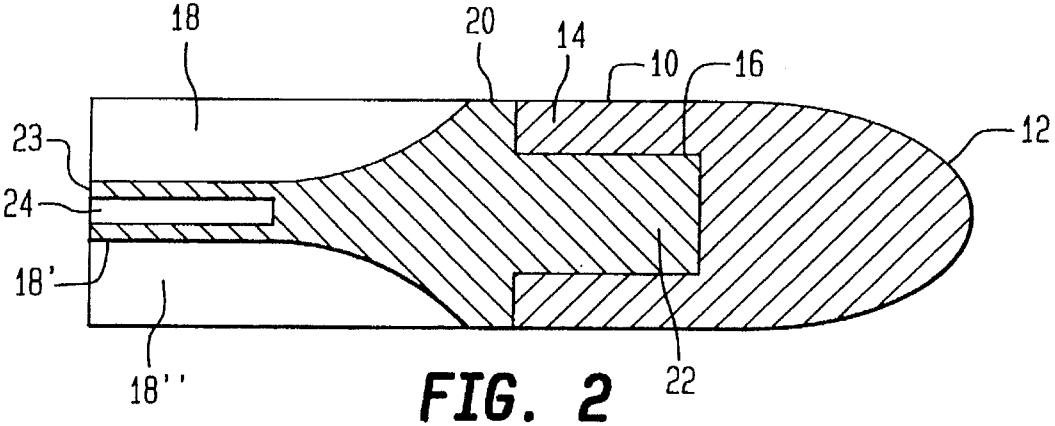
FIG. 2 is a diametral longitudinal cross sectional view of the projectile of FIG. 1 taken along line 2—2.

Referring now to FIGS. 1 and 2, the projectile has a cylindrically shaped body member 10 with an ogive shaped front end 12 and a rear end 14 having an axially disposed bore 16 therein. A rear end fin assembly member has four equally spaced fins 18, 18', 18", 18''' which are fixedly attached to the cylindrically shaped front end fin assembly 20 which has an axial disposed cylindrical boss 22 which is fixedly positioned in body bore 16 so that they cannot separate. This may be accomplished by use of a press fit assembly, by threading bore 16 and boss 22 so that they can be screwed together, or by pinning the boss 22 to the body 10 by conventional means well known in the art. The fins 18, 18', 18", 18''' have little or no cant or twist. The aft fin assembly end 23 is hollowed out at the base by a counter bore 24 which contributes to rotational and lateral mass asymmetry. This asymmetry causes the projectile to fly at a small angle of yaw or "trim angle". At spin rates away from resonance, this trim angle has a negligible effect on the flight for a predetermined range.

Figure 3:
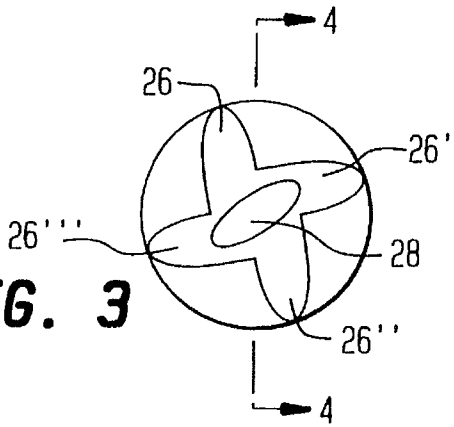
FIG. 3 is a base end view of a statically stable limited range projectile for a smooth bore gun.
Figure 4:
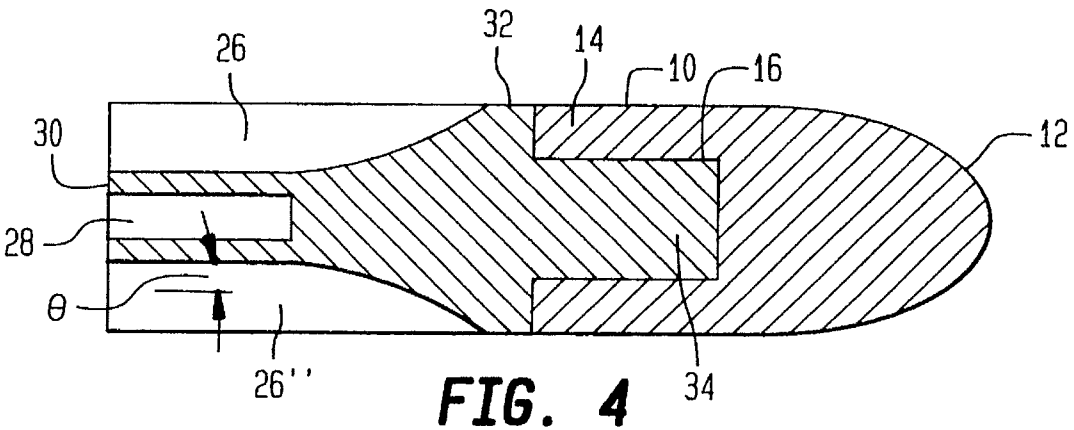
FIG. 4 is a diametral longitudinal cross sectional view of the projectile of FIG. 3 taken along line 4—4.

Referring now to FIGS. 3 and 4 the smooth bore projectile has cylindrical body member 10 with an ogive front end 12 and an axial bore 16 in rear end 14 similar to body member shown in FIG. 2. However fins 26, 26', 26" and 26''' have a significant cant or twist angle θ. A fin assembly counter oval bore 28 is located on the fin base end 30. Bore 28 having a shape and depth designed for mass asymmetry. The cylindrical fin assembly member 32 with its axial centered boss 34 is fixedly attached to projectile body member 10 in a similar manner as aforedescribed for FIGS. 1 and 2.

In operation the finned limited range training projectiles shown in FIGS. 1–4 are designed to closely match the standard round to 200 meters and have a maximum range that does not exceed 500 meters. The fin assemblies 20 and 32 of FIGS. 2 and 4 respectively and their mass distribution are designed to contribute static stability to the projectile. At launch from a rifled barrel, for the configuration shown in FIGS. 1 and 2, the projectile is subject to high spin. After approximately 200 meters, the fins 18, 18', 18", and 18''' decelerate the spin to the rate at which the projectile yaws. As the spin rate approaches the yaw frequency, the angular motion grows rapidly due to the amplification of the rolling trim angle that is the result of the mass asymmetry. The fins 18–18''' along with the front end body 10, the ogive 12 and the cylindrical assembly member 20 generate a large aerodynamic drag which greatly retards the flight and thus limits the range. The spin yaw resonance phenomenon occurs at a predetermined range so as to meet the ballistic match requirement and the range limitation.

The projectile shown in FIGS. 3 and 4 has a similar operation to that aforedescribed when it is fired from a smooth bore weapon, except that the canted or twisted fins 26–26''' in this embodiment spin the projectile up to the yaw rate.

While a specific embodiment of the invention has been shown and described in detail to illustrate the application of the principles of the invention, it will be understood that the invention may be embodied otherwise without departing from such principles.

What is claimed is:

1. A statically stable limited range projectile which comprises:

fin means for generating projectile yaw to limit said projectile's range, which includes:

a cylindrically shaped body member having an axially aligned boss at a front end thereof;

spin dampening and aerodynamic means for giving said projectile static stability for a limited range and for inducing yaw resonance at a particular spin rate subjecting said projectile to unstable flight, high drag, and limiting said projectile to a predetermined maximum range;

said spin dampening and aerodynamic means includes canted equally spaced fins disposed on a rear end of said cylindrically shaped body member which generate a spin rate to enable said projectile to attain resonance spin rate when said projectile is fired from a smooth bore weapon, said canted fins having a fin assembly fin base end having an oval cylindrically shaped counter bore therein axially aligned with a longitudinal axis of said projectile; and ogive shaped body means fixedly attached to said front end of said fin means for giving said projectile the flight characteristics of a standard round up to 200 meters and has a maximum range which does not exceed 500 meters, which includes;

a rear end having an axially aligned bore therein holding said body member boss operatively thereto.

2. A projectile as recited in claim 1 wherein said canted equally spaced fins have a fin cant angle θ, said canted fins having an outer diameter substantially equal to the diameter of said ogive body means.

3. A projectile as recited in claim 2 wherein said oval cylindrically shaped counter bore produces mass asymmetry and spin yaw instability at a predetermined projectile range.

* * * * *